US007306203B2

(12) United States Patent
Platt

(10) Patent No.: US 7,306,203 B2
(45) Date of Patent: Dec. 11, 2007

(54) POST ASSEMBLY AND SPACER FOR USE THEREWITH

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 16 days.

(21) Appl. No.: 11/385,324

(22) Filed: Mar. 21, 2006

(65) Prior Publication Data

US 2006/0169967 A1 Aug. 3, 2006

Related U.S. Application Data

(63) Continuation-in-part of application No. 11/046,499, filed on Jan. 28, 2005.

(51) Int. Cl.
*E04H 17/00* (2006.01)

(52) U.S. Cl. ..... 256/65.14; 256/65.01; 256/65.02; 256/65.03; 256/65.04

(58) Field of Classification Search ..... 256/59, 256/65.01–65.06, 65.14, DIG. 5, 1; 52/296
See application file for complete search history.

(56) References Cited

U.S. PATENT DOCUMENTS 3,463,456 A * 8/1969 Walker ..... 256/22
3,993,289 A * 11/1976 Lewis et al. ..... 256/59
5,022,618 A * 6/1991 Barrett et al. ..... 248/146
5,335,471 A * 8/1994 Kupiec ..... 52/737.4
5,755,431 A * 5/1998 Williams ..... 256/19
6,141,928 A 11/2000 Platt
6,305,670 B1 * 10/2001 Ward et al. ..... 256/59
6,467,756 B1 * 10/2002 Elsasser ..... 256/65.14
6,585,234 B2 * 7/2003 Berto ..... 256/19
6,718,710 B2 4/2004 Platt
2003/0221385 A1 * 12/2003 Platt ..... 52/296
2004/0026679 A1 * 2/2004 Terrels et al. ..... 256/65.03
2004/0056241 A1 * 3/2004 Calverley ..... 256/65.02
2005/0127346 A1 * 6/2005 Steffes ..... 256/65.05
2006/0022188 A1 * 2/2006 Collins ..... 256/65.14
2006/0065885 A1 * 3/2006 Stanley ..... 256/59

* cited by examiner

*Primary Examiner*—James M. Hewitt
*Assistant Examiner*—Daniel J. Mills
(74) *Attorney, Agent, or Firm*—Sand & Sebolt

(57) ABSTRACT

A fencing system includes a vertically elongated post mount mountable on a foundation and one or more post inserts mounted on the post mount to provide a stable structure for fastening thereto rail mounting brackets and associated rails. Each post insert extends outwardly from the post mount and typically abuts an inner surface of a hollow post. Fasteners extend from the rail mounting bracket through the post and into the post insert to provide a strong connection for the mounting of the rail mounting bracket and rail. The post inserts may be mounted on the post mount without tools. One of the post inserts serves as a spacer for setting the height of associated rail mounting brackets and rails. The spacer may include two members which are removably connected to one another via a friction fit to provide various benefits.

22 Claims, 14 Drawing Sheets

POST ASSEMBLY AND SPACER FOR USE THEREWITH

CROSS REFERENCE TO RELATED APPLICATIONS

This application is a continuation-in-part of U.S. patent application Ser. No. 11/046,499 filed Jan. 28, 2005; the disclosure of which is incorporated herein by reference.

BACKGROUND OF THE INVENTION

1. Technical Field

The invention relates generally to a fencing system or railing system. More particularly, the invention relates to a fencing system having a post support which provides sturdy mounting of the railing structure. Specifically, the invention relates to such a post support having a post insert mounted on a post mount with the railing structure secured to the post insert.

2. Background Information

Fencing and railing systems commonly utilize vertically mounted post structures with horizontal railing structures extending between and mounted on adjacent post structures. It is known in the art to utilize a post mount which is mounted on the ground or to a floor structure of some sort with the post mount slidably received within a hollow post whereby various types of structure attached to the post mount engages the inner surface of the post in order to provide support to the post. The various structure mounted on the post mount to help support the post either is disposed closely adjacent the inner surface of the post or in contact with said inner surface. One example of such a configuration is disclosed in U.S. Pat. No. 6,141,928 granted to the Applicant. Said patent discloses a post mount having fins or other outwardly projecting structure formed integrally therewith which frictionally engage the inner surface of the post to provide support thereto. Another example is disclosed in U.S. Pat. No. 6,718,710 granted to the Applicant. Said patent discloses a post mount having a head seated atop the post mount with a plurality of tabs extending outwardly therefrom which frictionally engage the inner surface of the post to provide support thereto. Both of said patents are incorporated herein by reference. Other post mounts are known in the arts which have somewhat similar structures.

While these patents and other structures provide suitable support to the post for many purposes, there remains a need in the art for a connection between the railing structure and the post structures whereby said connection is substantially sturdier than those presently known. Most typically, the railing structures are secured by a fastener typically in the form of a screw or bolt to the post itself. Especially for railing structures that are elevated substantially above the ground or floor to which the post mount is attached, such a connection is not as sturdy as desired for certain applications.

BRIEF SUMMARY OF THE INVENTION

The present invention provides a fencing system comprising a post mount having an upper end, a lower end and an outer surface extending therebetween; the post mount being adapted to be mounted adjacent the lower end thereof to a foundation; a post insert having an upper end, a lower end and an outer surface which extends therebetween wherein a portion of the outer surface of the post insert is disposed outwardly of the outer surface of the post mount; the post insert being mounted on the post mount adjacent the upper end of the post mount; a structural member defining a cavity in an end thereof; the post mount and post insert being slidably received in the cavity of the structural member; and a rail structure secured to the post.

The present invention further provides a fencing system comprising a mounting structure having upper and lower ends; the mounting structure being adapted to be mounted adjacent the lower end thereof to a foundation; a structural member defining a cavity in an end thereof; the mounting structure being slidably received in the cavity of the structural member; a rail structure; and at least one fastener extending from the rail structure through the structural member to the mounting structure to secure the rail structure and the structural member to the mounting structure.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
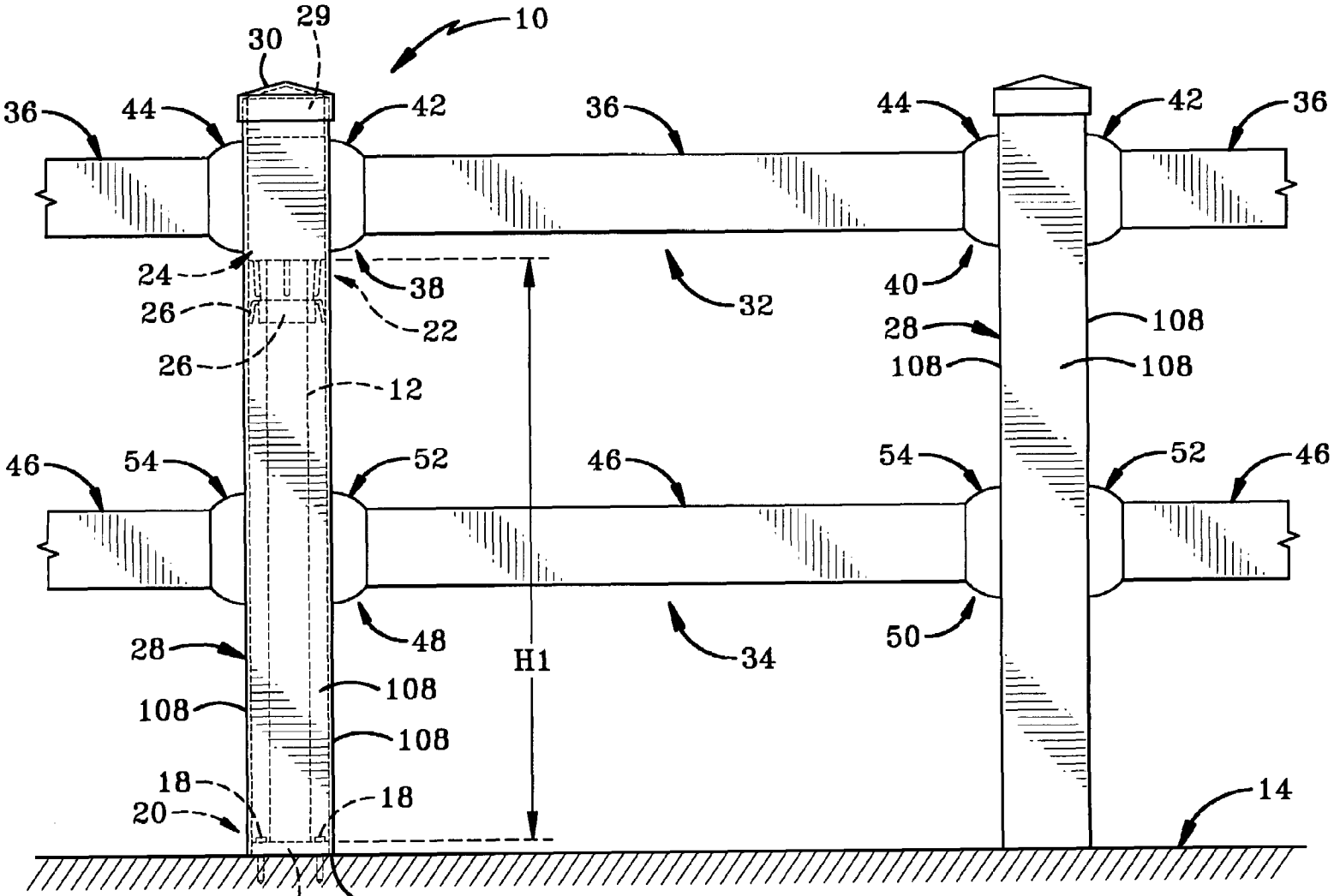
FIG. 1 is an elevational view showing the fence system of the present invention with the posts and railing structures in solid lines and the post mount, post insert and related structure in dashed lines.

The fencing system of the present invention is indicated generally at 10 in FIG. 1. System 10 includes a post mount 12 which is mounted on a foundation or base structure 14 such as a floorboard of a floor or platform, a concrete floor or the like or the ground itself. Post mount 12 is typically mounted on a plate 16 adjacent a lower end 20 thereof by welding, for example, and mounted via plate 16 to base structure 14 via bolts 18 or other suitable fasteners known in the art. Some examples of mounting structures for mounting a post mount are described in more detail in the above-referenced patents granted to the Applicant. Post mount 12 has an upper end 22 and is elongated between lower and upper ends 20 and 22, having a height H1 extending from upper end 20 to lower end 22.

In accordance with a feature of the invention and with continued reference to FIG. 1, system 10 includes a post insert 24 mounted atop post mount 12 adjacent upper end 22 thereof and distal lower end 20, as will be further detailed below. System 10 may also include outward projections 26 which extend outwardly from post mount 12. System 10 further includes a hollow post 28 having an upper end 29 and a lower end 31 which slides over post insert 24, projections 26, post mount 12 and plate 16. System 10 may include a cap member 30 seated atop post 28. System 10 includes an upper rail structure 32 and a lower rail structure 34 each mounted between a pair of adjacent posts 28. Upper rail structure 32 includes a rail 36 having a first end 38 and a second end 40 opposed thereto with rail 36 being elongated there between. Upper rail structure 32 further includes a rail mounting bracket 42 mounted on each post 28 as necessary to support rail 36 adjacent first end 38 thereof. Another rail mounting bracket 44 is mounted on each post 28 whereby the bracket 44 mounted on an adjacent post 28 supports rail 36 adjacent second end 40 thereof.

Lower rail structure 34 likewise includes a rail 46 having a first end 48 and the second end 50 opposed thereto and being elongated between ends 48 and 50. Lower rail structure 34 also includes a rail mounting bracket 52 mounted on each post 28 for supporting rail 46 adjacent first end 48 thereof. Another rail mounting bracket 54 is mounted on each post 28 opposite a respective rail mounting bracket 52 whereby each rail mounting bracket 54 supports one of rails 46 adjacent respective second end 50 thereof. Lower rail structure 34 is mounted in a conventional manner to a pair of adjacent posts 28.

Figure 2:
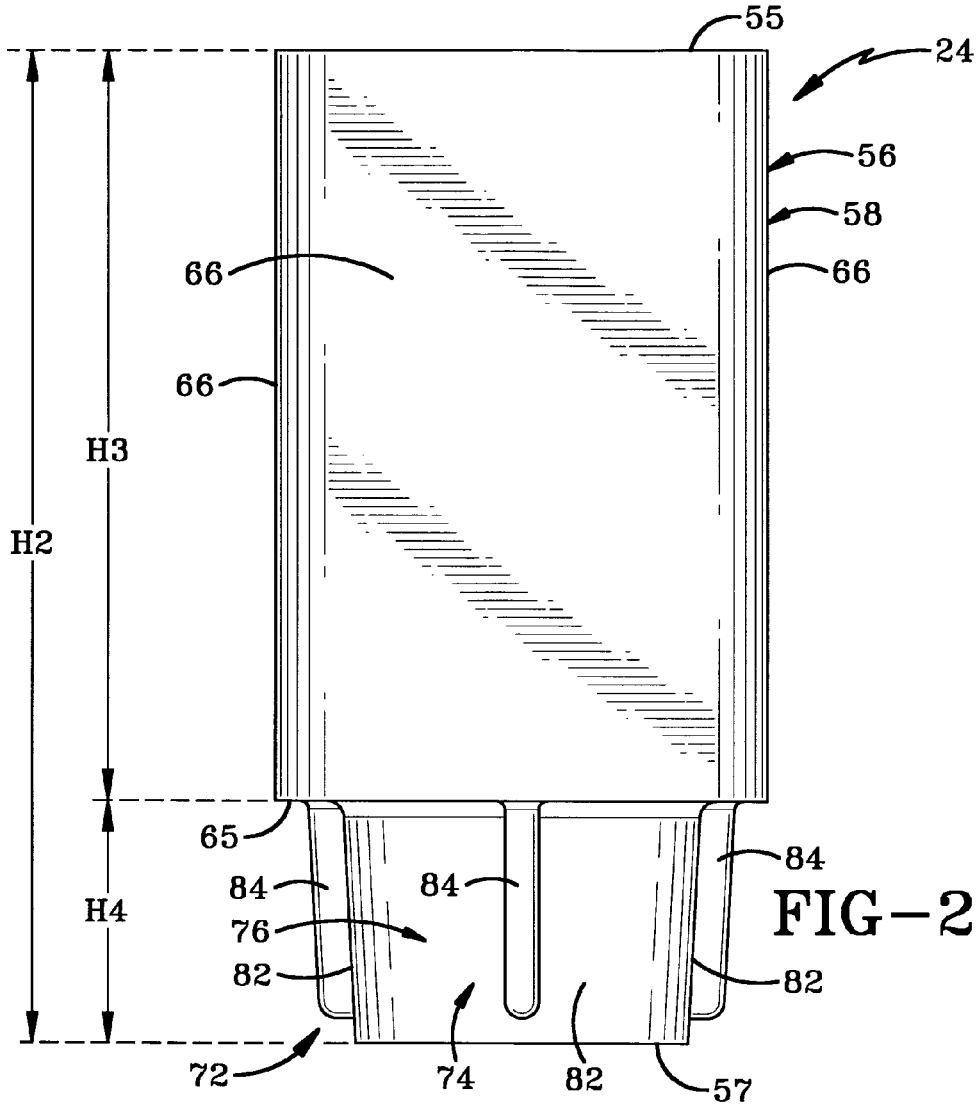
FIG. 2 is an elevational view of a first embodiment of the post insert of the present invention.
Figure 3:
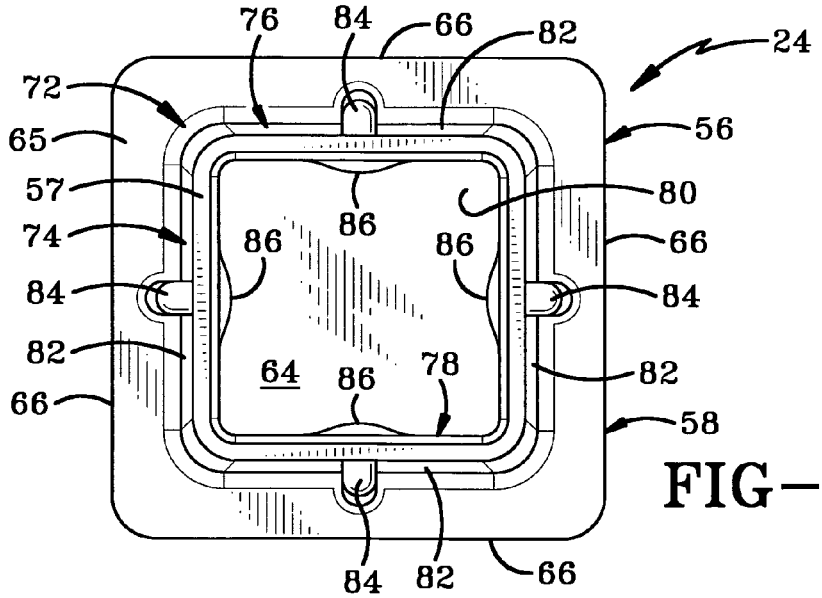
FIG. 3 is a top plan view of the first embodiment of the post insert shown in FIG. 2.
Figure 4:
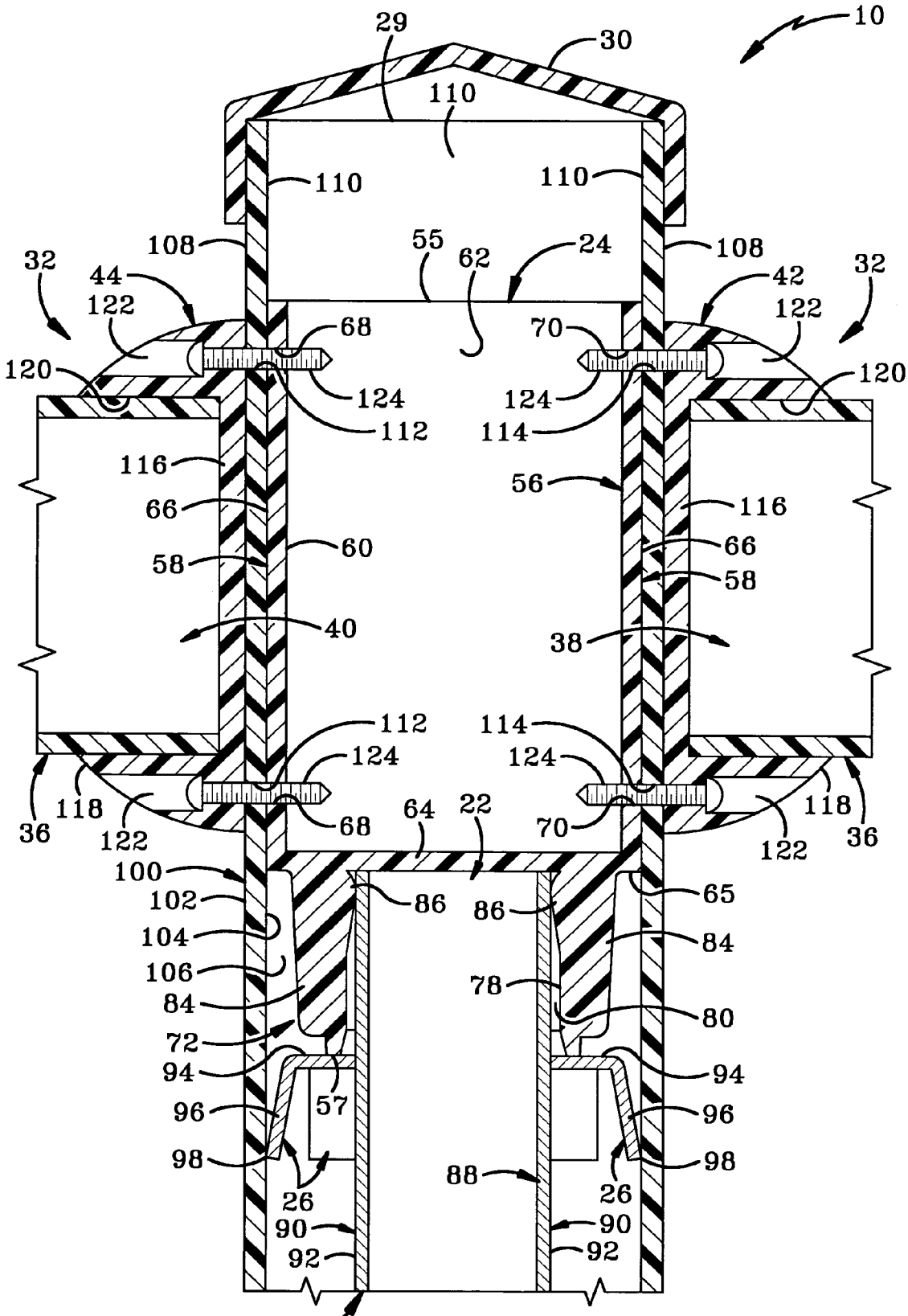
FIG. 4 is an enlarged fragmentary sectional view of a portion of FIG. 1 showing the first embodiment of the post insert in relation to the various other structures of the fence system.

With reference to FIGS. 2-4, post insert 24 is further detailed. Post insert 24 has an upper end 55 and a lower end 57 and is elongated therebetween, with lower end 57 being spaced upwardly a substantial distance (nearly that of height H1) from lower end 20 of post mount 12. Post insert 24 has a height H2 (FIG. 2) extending from upper end 55 to lower end 57. Height H1 (FIG. 1) of post mount 12 is over three times that of height H2 of post insert 24. Post insert 24 includes an upper sleeve or sidewall 56 having an outer surface 58 and an inner surface 60 (FIG. 4) defining an interior chamber or upwardly opening cavity 62. Upper sidewall 56 is substantially square as viewed from above or below although the shape may vary. Preferably however, sidewall 56 is non-circular in cross-section. Upper sidewall 56 extends upwardly from a separating wall 64 (FIG. 4) which serves as a base wall bounding the lower end of cavity 62. Upper sidewall 56 has a lower end 65 coincident with a lower surface of separating wall 64 and a height H3 (FIG. 2) extending from upper end 55 to lower end 65 which is approximately ¾ that of height H2 of post insert 24. Upper sidewall 56 includes four exterior flat portions 66 (FIGS. 2-3). Sidewall 56 defines a pair of holes 68 along one of the flat portions 66 and a second pair of holes 70 along opposed front portion 66 (FIG. 4). Holes 68 and 70 may be threaded if desired.

With continued reference to FIGS. 2-4, post insert 24 further includes a collar 72 extending downwardly from separating wall 64. Collar 72 includes a lower sidewall 74 which is substantially square in cross section and has an outer surface 76 and an inner surface 78 defining an interior chamber or downwardly opening cavity 80. Lower sidewall 74 is stepped inwardly from upper sidewall 56 at lower end 65 of sidewall 56 whereby outer surface 76 of lower sidewall 74 is disposed inwardly of outer surface 58 of upper sidewall 56. Lower sidewall 74 has a height H4 (FIG. 2) extending from lower end 65 of upper sidewall 56 to lower end 57 of post insert 24. Height H3 of upper sidewall 56 is approximately three times that of height H4 of lower sidewall 74. Lower sidewall 74 includes four substantially flat walls 82 with a respective projection or strengthening rib 84 extending outwardly from each flat wall 82 and formed integrally therewith. Each rib 84 extends from adjacent lower end 57 of post insert 24 to separating wall 64 to which rib 84 is connected and with which it is integrally formed. Collar 72 includes four projections 86 each of which extends inwardly from lower sidewall 74 and is integrally formed therewith, each projection 86 defining a portion of inner surface 78 and defining a portion of downwardly opening cavity 80. More particularly, each projection 86 extends inwardly from a respective flat wall 82 of sidewall 74. Projections 86 are disposed adjacent separating wall 64 which bounds an upper end of cavity 80.

With reference to FIG. 4, post mount 12 is further detailed. Post mount 12 is a hollow structure including a sidewall 88 which is substantially square in cross-section and has an outer surface 90. The square cross-sectional configuration provides for four exterior flat portions 92 (only two flat portions 92 are shown in FIG. 4). Post mount 12 adjacent upper end 22 thereof is slidably received within downwardly opening cavity 80 of post insert 24 so that upper end 22 abuts separating wall 64 of post insert 24. Thus, the lower surface of separating wall 64 is disposed a distance equal to height H1 (FIG. 1) from lower end 20 of post mount 12 when post insert 24 is mounted on post mount 12. In addition, outer surface 90 of sidewall 88 of post insert 24 engages inner surface 78 of lower sidewall 74 along projections 86. More particularly, each flat portion 92 of sidewall 88 is in frictional engagement with a respective inward projection 86. Post insert 24 may thus be mounted on post mount 12 without the use of tools.

With further reference to FIG. 4, each outward projection 26 mounted on post mount 12 includes an upper substantially horizontal leg 94 which extends outwardly from and is connected to post mount 12 adjacent and spaced downwardly from upper end 22. A tab 96 angles downwardly and outwardly from and is connected to leg 94, each tab 96 having an outermost edge 98. Lower end 57 of post insert 24 is seated atop an upper surface of leg 94 of each outward projection 26.

With continued reference to FIG. 4, post 28 has a sidewall 100 which is substantially square in cross-section and is elongated between upper end 29 and lower end 31 (FIG. 1). Sidewall 100 has an outer surface 102 and an inner surface 104 defining an interior chamber or cavity 106 which opens upwardly adjacent upper end 29 and opens downwardly adjacent lower end 31. Outer surface 102 of sidewall 100 includes four flat exterior surfaces 108, two of which are shown in FIG. 4. Inner surface 104 of sidewall 100 includes four interior flat surfaces 110, three of which are shown in FIG. 4. Sidewall 100 defines a pair of holes 112 extending from one exterior flat surface 108 to a corresponding interior flat surface 110 whereby holes 112 are aligned with respective holes 68 in post insert 24. Sidewall 100 also defines a pair of holes 114 extending from another exterior flat surface 108 to a corresponding interior flat surface 110, the latter of said flat surfaces 108 and 110 being on the opposite side of post 28 from holes 112. Holes 114 are aligned respectively with holes 70 in post insert 24. Holes 68, 70, 112 and 114 are all disposed upwardly of upper end 22 of post mount 12.

When assembled (FIG. 4), post insert 24, post mount 12 and outward projections 26 are slidably received within cavity 106 of post 28. Outermost edges 98 of tabs 96 of projections 26 are in frictional engagement with respective interior flat surfaces 110 of sidewall 100 of post 28. Post insert 24 is positioned within cavity 106 of post 28 so that upper end 55 of post mount 24 is adjacent upper end 29 of post 28. In addition, outer surface 58 of post insert 24 is disposed closely adjacent or in contact with inner surface 104 of post 28. In particular, each flat portion 66 of post insert 24 is closely adjacent or in contact with a respective interior flat surface 110 of post 28. More particularly, outer surface 58 is closely adjacent inner surface 104 of post 28 adjacent upper end 55 and lower end 65 of sidewall 56. Preferably, outer surface 58 of sidewall 56 is in its entirety closely adjacent inner surface 104 of post 28.

With continued reference to FIG. 4, rail mounting bracket 42 includes a base wall 116 and a collar 118 extending outwardly therefrom to define a cavity 120 in which first end 38 of one rail 36 is slidably received with first end 38 closely adjacent or in contact with base wall 116. Collar 118 and base wall 116 of bracket 42 further define a pair of counterbore holes 122 which are aligned with respective holes 114 in post 28 and 70 in post insert 24. A pair of fasteners in the form of threaded screws 124 are each inserted via one of counterbore holes 122 through respective holes 114 and 70, with each screw 124 threadably engaging hole 70 to secure rail mounting bracket 42 to post insert 24 with a portion of sidewall 100 of post 28 sandwiched therebetween, thereby mounting upper rail structure 32 to post 28 and post mount 12.

Thus, in accordance with a feature of the invention, rail mounting bracket 42 is connected to post insert 24 as opposed to being connected solely to post 28, thereby providing a substantially sturdier connection. In addition, because upper sidewall 56 of post insert 24 extends upwardly of upper end 22 of post mount 12, rail mounting bracket 42 is disposed upwardly of upper end 22 of post mount 12. Indeed, bracket 42 is disposed entirely above upper end 22 of post mount 12 whereby first end 38 of rail 36 is also disposed entirely above upper end 22. Since each rail 36 is substantially straight and substantially horizontal, each rail 36 therefore is disposed entirely above upper end 22 of post 12 so that the entire rail structure 32 is disposed entirely above upper end 22 of post 12. Rail mounting bracket 44 has the same configuration as rail mounting bracket 42 or is a mirror image thereof, is numbered similarly and mounted as described with regard to bracket 42. Thus, second end 40 of second rail 36 is received in cavity 120 of mounting bracket 44 with second end 40 disposed closely adjacent or in contact with base wall 116 of bracket 44. Similar to bracket 42, rail mounting bracket 44 is secured to post insert 24 by a pair of threaded screws 124 extending via respective counterbore holes 122 through respective holes 112 and 68 with each screw 124 threadably engaging hole 68. Cap member 30 is seated atop post 28 to protect the hollow interior chamber 106 thereof from the elements and provide preferred aesthetics.

Figure 5:
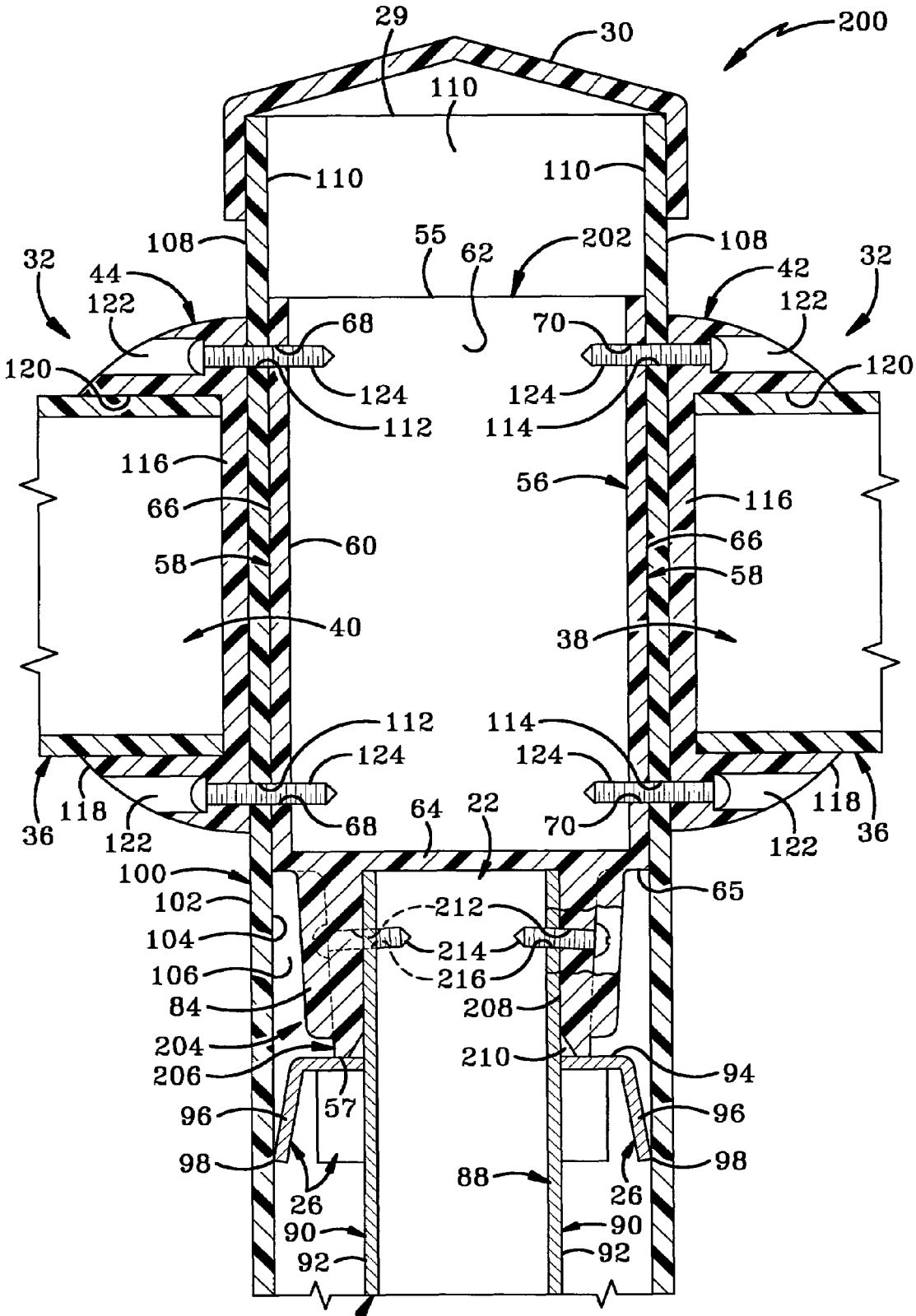
FIG. 5 is similar to FIG. 4 and shows a second embodiment of the post insert of the present invention.

With reference to FIG. 5, fencing system 200 is described. System 200 is similar to system 10 except that it has a post insert 202 which is slightly different than that of post insert 24 of system 10. In particular, post insert 202 is similar to post insert 24 except with regard to a collar 204 which differs from collar 72 of post insert 24. Collar 204 is free of inward projections such as projections 86 of post insert 24. Thus, collar 204 includes a lower sidewall 206 having a substantially square inner surface 208 which is in mating configuration to outer surface 90 of post mount 12 along virtually the entire length of the portion of post mount 12 adjacent upper end 22 thereof which is slidably received within a downwardly opening cavity 210 defined by inner surface 208 of collar 204. In addition, collar 204 defines a plurality of holes as at 212 through which respective fasteners in the form of threaded screws 214 extend and threadably engage holes 216 (which may or may not be threaded) formed in post mount 12 adjacent upper end 22 thereof to further secure post insert 202 to post mount 12. Screws 214 are optional and may be used in the first embodiment as well if desired.

Thus, fencing systems 10 and 200 provide a sturdier mounting system than is known of in the prior art. In particular, post insert 24 provides a sturdier mounting structure to which upper rail structure 32 may be mounted. In particular, post inserts 24 and 202 each provide a structure other than the post itself to which the rail structures or rail mounting brackets are directly secured. Further, outer surface 58 of post insert 24 provides a substantial surface area which is disposed closely adjacent or in contact with inner surface 104 of post 28, thus providing greater stability or sturdiness via a surface area which is larger than in known prior art as well as a substantial area which is closely adjacent or in abutment with the inner surface of the post. Post insert 24 or 202 is also firmly mounted atop post mount 12 as previously described with engagement with post mount 12 and inward projections 86 of post insert 24 or the elongated inner surface 208 of post insert 202. In addition, lower end 57 of post insert 24 or 202 abuts legs 94 of projections 26 to enhance the stable mounting of post inserts 24 and 202. Fasteners such as screws 214 may also increase this stability. Moreover, post mounts 24 and 202 extend primarily upwardly of upper end 22 of post mount 12, thereby allowing post mount 12 to be shorter while the post mount provides sufficient height for mounting of the rail structure.

It will be evident to one skilled in the art that a variety of changes could be made to present embodiments described which are within the scope of the present invention. For example, as previously mentioned or implied, the cross-sectional shapes of the post, the post insert and the post mount may take on a variety of shapes other than square while still being within the scope of the present invention. As previously noted, preferably these cross-sectional shapes are non-circular in order to facilitate the alignment of the various pieces and related holes and fasteners. In addition, it is preferred that the cross-sectional shape of the outer surface of the post insert upper sidewall is substantially the same as that of the inner surface of the post. It is also preferred that this be the case for the outer surface of the post mount and the inner surface of the lower sidewall of the post insert in the area where they engage one another.

Most typically, post mount 12 is formed of a metal or metal alloy to provide the desired strength, although this may vary for certain applications. Most typically, the post mounts are formed of an extrudable shape to keep costs lower. Similarly, the posts and rails are most preferably formed of extrudable materials and shapes. Most commonly, the rails, rail mounting brackets, post and post insert will be formed of a sturdy plastic material, although again this may vary in accordance with the application.

In addition, rail structures 36 and 46 are shown in the drawings as being formed from more than one piece, namely a rail 36 and rail mounting bracket 42 or 44. Such a configuration allows the rail to be extrudable as previously noted. However, it is contemplated that the rail structure may be a one-piece member which may be formed integrally and has suitable flanges or other structure suitable for mounting to the post insert. Most preferably, the rail structures are mounted to the post insert via fasteners which extend through holes as described and most preferably involve a threaded engagement between the fastener and the post insert. However, other types of suitable fasteners may be used to secure the rail structure to the post insert. For example, fasteners which extend through holes analogous to those described herein and which engage a second fastening member such as a nut may be used. Although this type fastener may require additional effort during assembly, the upwardly opening cavity of the post insert provides access from above to permit the use of these types of fasteners.

In addition, the collars of the post inserts as described herein define a cavity which slidably receives an upper end of the post mount in order to mount the post insert atop the post mount. However, it is contemplated that the first insert may be mounted with a downwardly extended projection which is inserted into the hollow interior of the post mount. However, a collar or similar structure disposed outwardly in the post mount is preferred to provide greater stability. Further, outward projections such as projections 26 which extend from the post mount may be eliminated although they provide additional support to the post insert as well as the post. The specific heights detailed herein may vary. However, the heights which are specified represent typical relationships between various structures of which those heights are given. Other changes within the scope of the invention will be evident to one skilled in the art.

Figure 6:
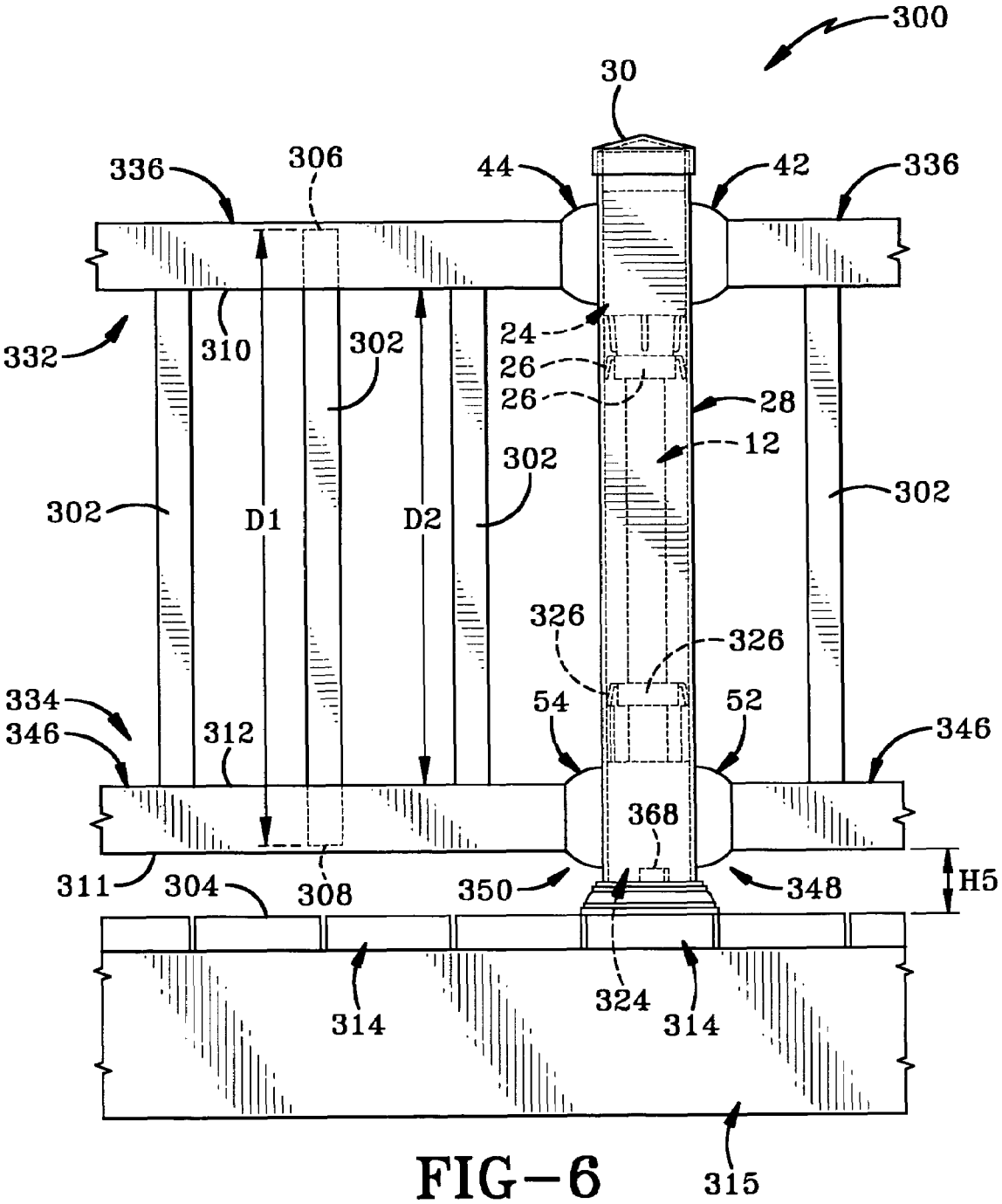
FIG. 6 is similar to FIG. 1 and shows a third embodiment of the fence system including the spacer of the present invention.

A third embodiment of the fencing system of the present invention is indicated generally at 300 in FIG. 6. System 300 includes many of the same elements of system 10. For instance, system 300 includes post mount 12, upper post insert 24, outward projections 26, hollow post 28, cap member 30 and rail mounting brackets 42,44, 52 and 54. Rail mounting brackets 52 and 54 (FIG. 13) have the same respective configurations as brackets 42 and 44 (FIG. 4) and are numbered accordingly. Rail mounting brackets 42 and 44 are part of an upper rail structure 332 and rail mounting brackets 52 and 54 are part of a lower rail structure 334. Rail structures 332 and 334 are analogous to and similar to upper and lower rail structures 32 and 34, but differ in that they respectively include an upper rail 336 and a lower rail 346 which are configured for mounting therebetween a plurality of spaced vertically elongated balusters 302. In addition, lower rail 346 is disposed lower than is lower rail 46 and opposed ends 348 and 350 of lower rail 346 are adjacent the respective lower ends of respective post mounts 12 and posts 28.

System 300 may include lower outward projections 326 which have the same configuration as upper projections 26 and are mounted on post mount 12 at a height substantially below projections 26, generally adjacent the lower ends of post mount 12 and post 28 and spaced upwardly from rail brackets 52 and 54 and lower rails 334. Post mount 12 of system 300 is mounted on a base structure shown as one of a plurality of floorboards 314 which are mounted atop support beams 315 and have respective upper surfaces 304.

In accordance with the invention, system 300 further includes a lower post insert or spacer 324 associated with alternate heights of lower rail 346. Post mount 12, post insert 24, projections 26 and 326, and spacer 324 are all part of a mounting structure which mounts on a base structure such as floor boards 314 for supporting post 28, rail structures 332 and 334 and balusters 302. Spacer 324 serves as a stabilizer or a strengthening structure which provides greater stability to mounting brackets 52 and 54 when secured thereto, much as upper post insert 24 provides such stability for rail mounting brackets 42 and 44. As will be discussed further in detail below, spacer 324 has first and second positions which are used respectively when lower rails 346 are to be used at different heights. FIG. 6 shows that a lower surface 311 of each lower rail 346 is spaced upwardly from upper surface 304 of floor boards 314 at a height H5. The size of balusters 302 is associated with this positioning of lower rail 346. More particularly, each baluster 302 has upper and lower ends 306 and 308 defining therebetween a length or distance D1. A lower surface 310 of upper rail 336 and an upper surface 312 of lower rail 346 define therebetween a distance D2 which is associated with balusters 302 having a length D1. Distances D1 and D2 are likewise associated with the positioning of lower rail 346 at height H5.

Figure 8:
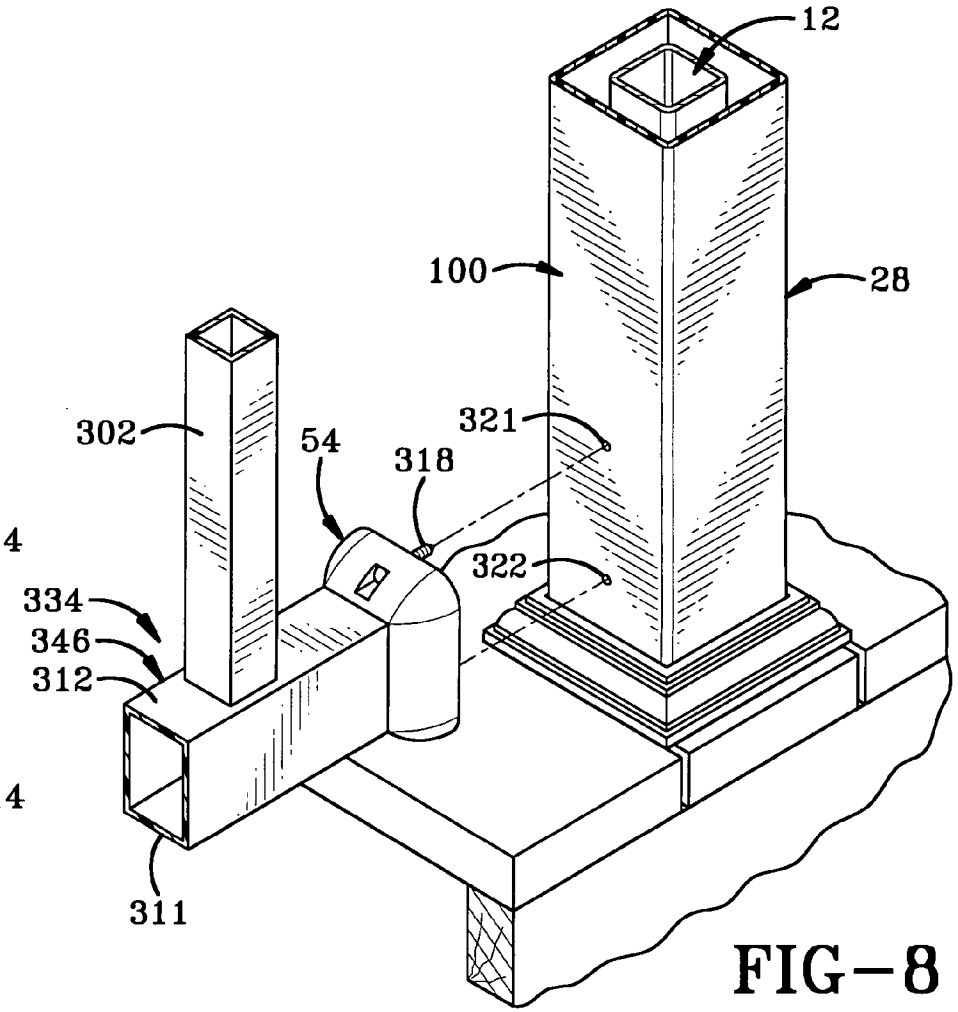
FIG. 8 is an exploded perspective view similar to FIG. 7 showing the rail mounting bracket aligned for mounting on the post.
Figure 7:
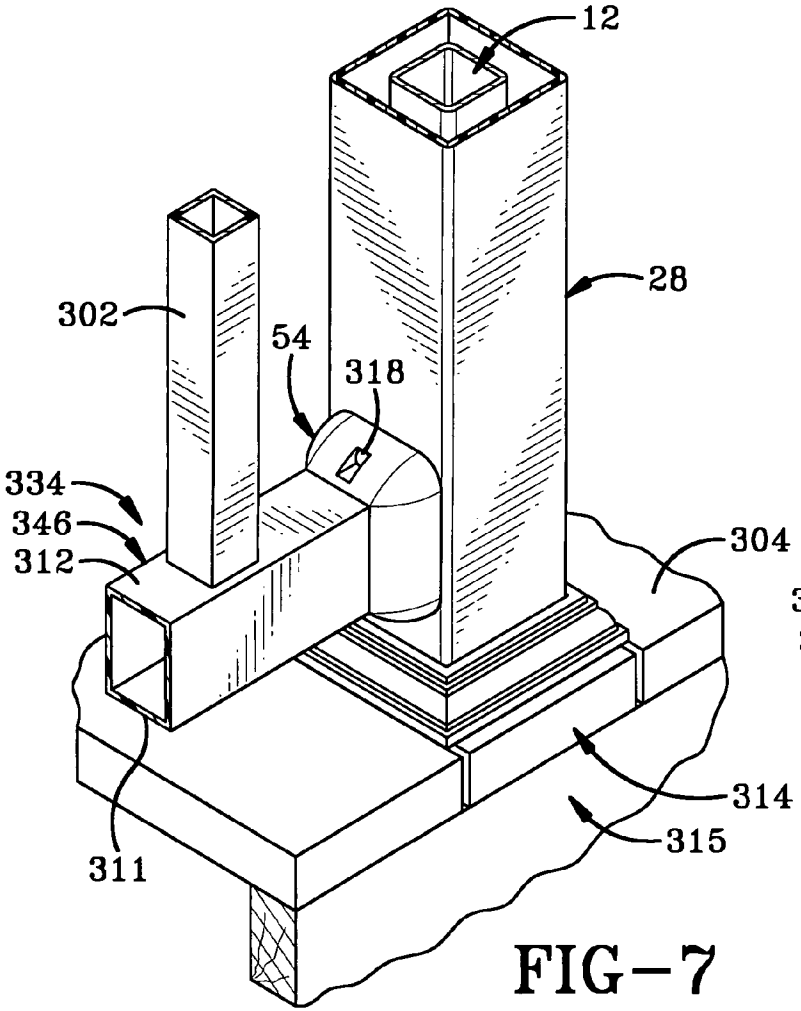
FIG. 7 is a fragmentary perspective view of the third embodiment showing a lower rail mounting bracket mounted on the post.

FIG. 7 shows rail mounting bracket 54 secured to post 28 via a pair of vertically spaced fasteners in the form of screws 318 and 320 (FIG. 13) to mount rail structure 346 to post 28. FIG. 8 shows a pair of spaced holes 321 and 322 formed in side wall 100 of post 28 which are aligned with and respectively receive screws 318 and 320. Holes 321 and 322 may or may not be preformed as will be discussed further below.

Figure 9:
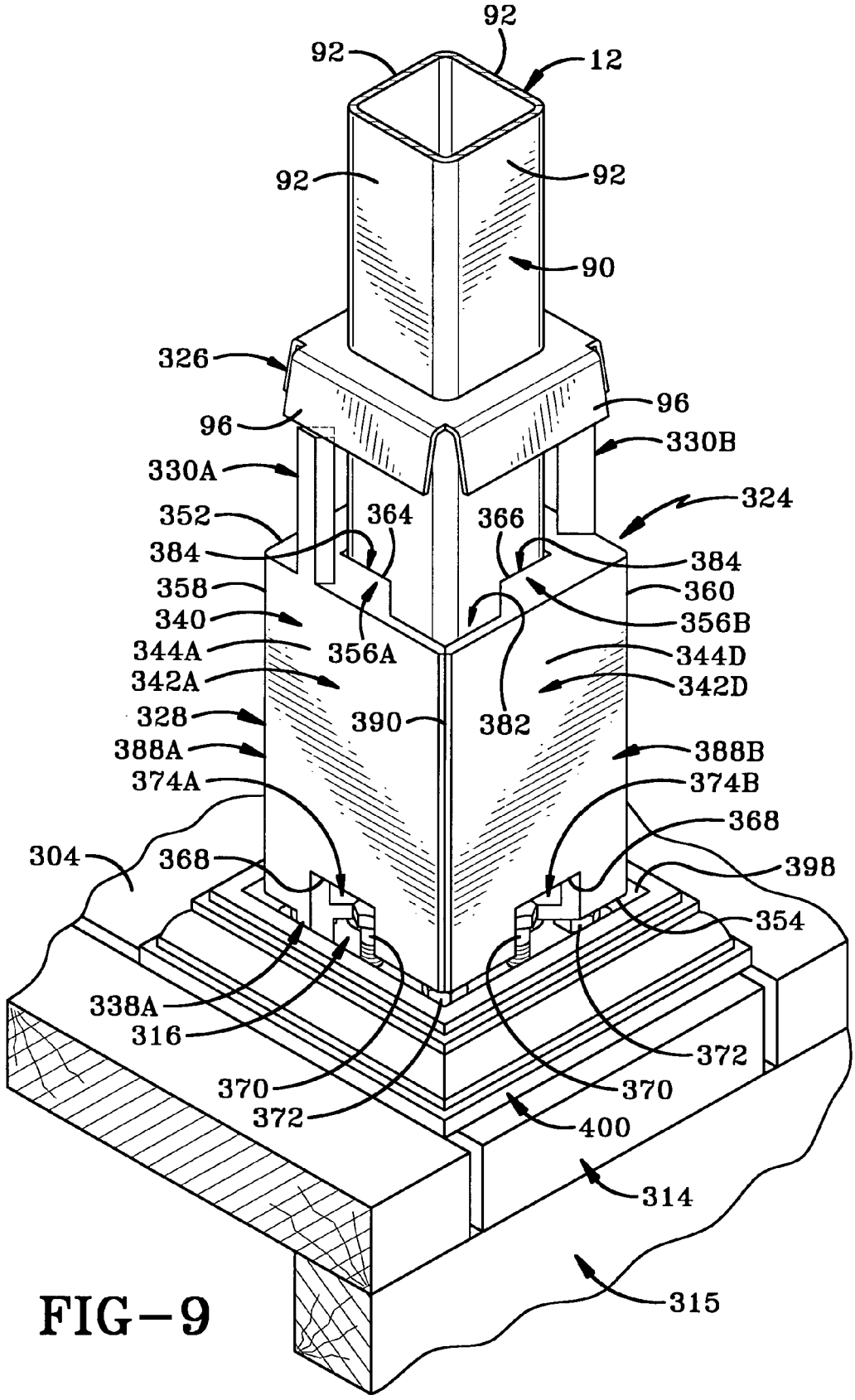
FIG. 9 is a perspective view showing a lower portion of the post mount with the spacer mounted thereon.
Figure 10:
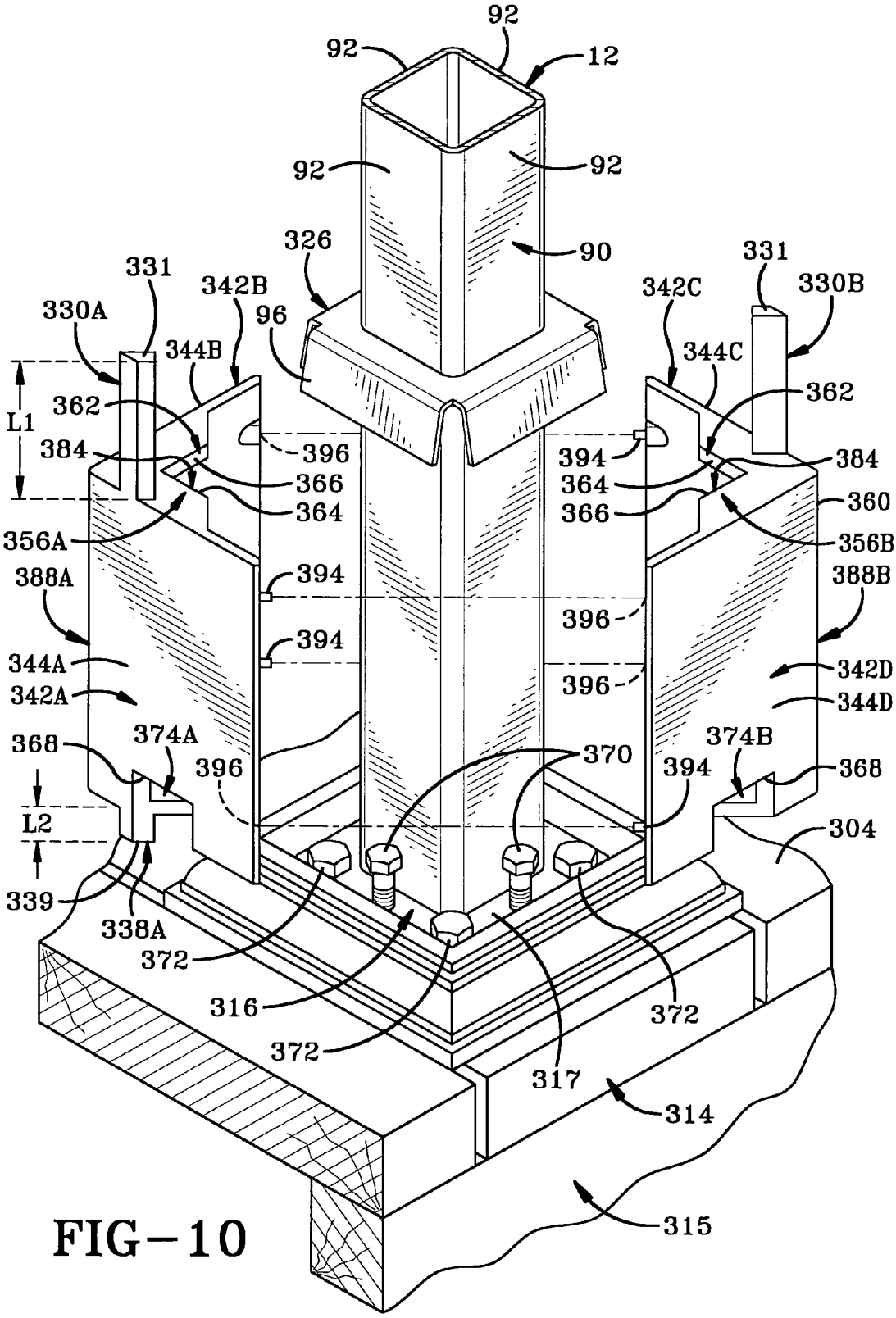
FIG. 10 is an exploded view similar to FIG. 9 showing the two pieces of the spacer separated from one another.
Figure 12:
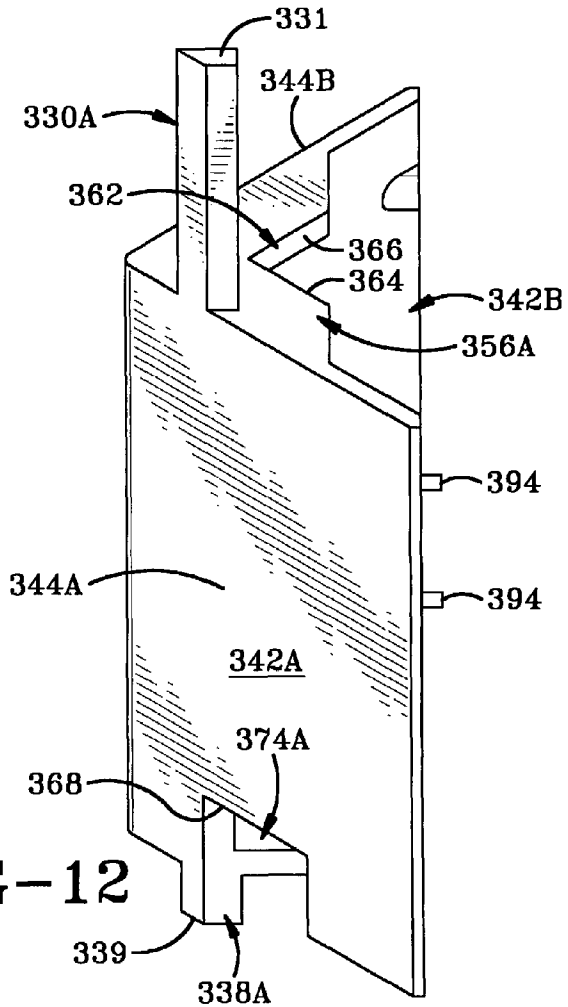
FIG. 12 is a perspective view of the half of the spacer shown in FIG. 11 turned 90° from the position shown in FIG. 11.
Figure 11:
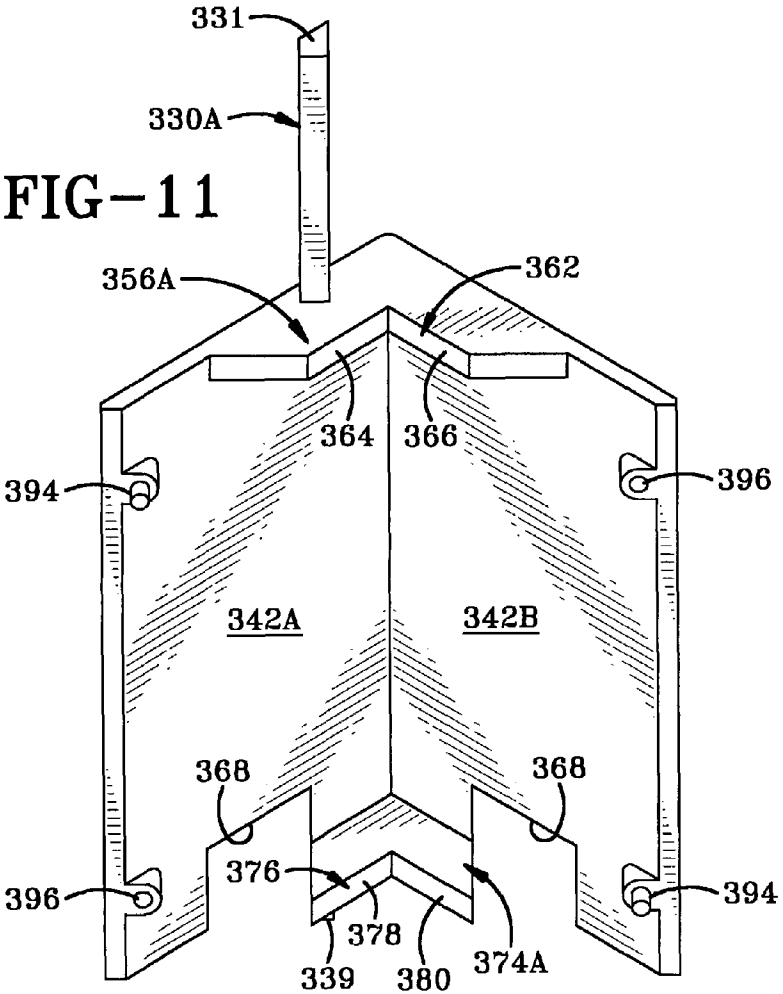
FIG. 11 is a perspective view of one half of the spacer showing the interior thereof.
Figure 13:
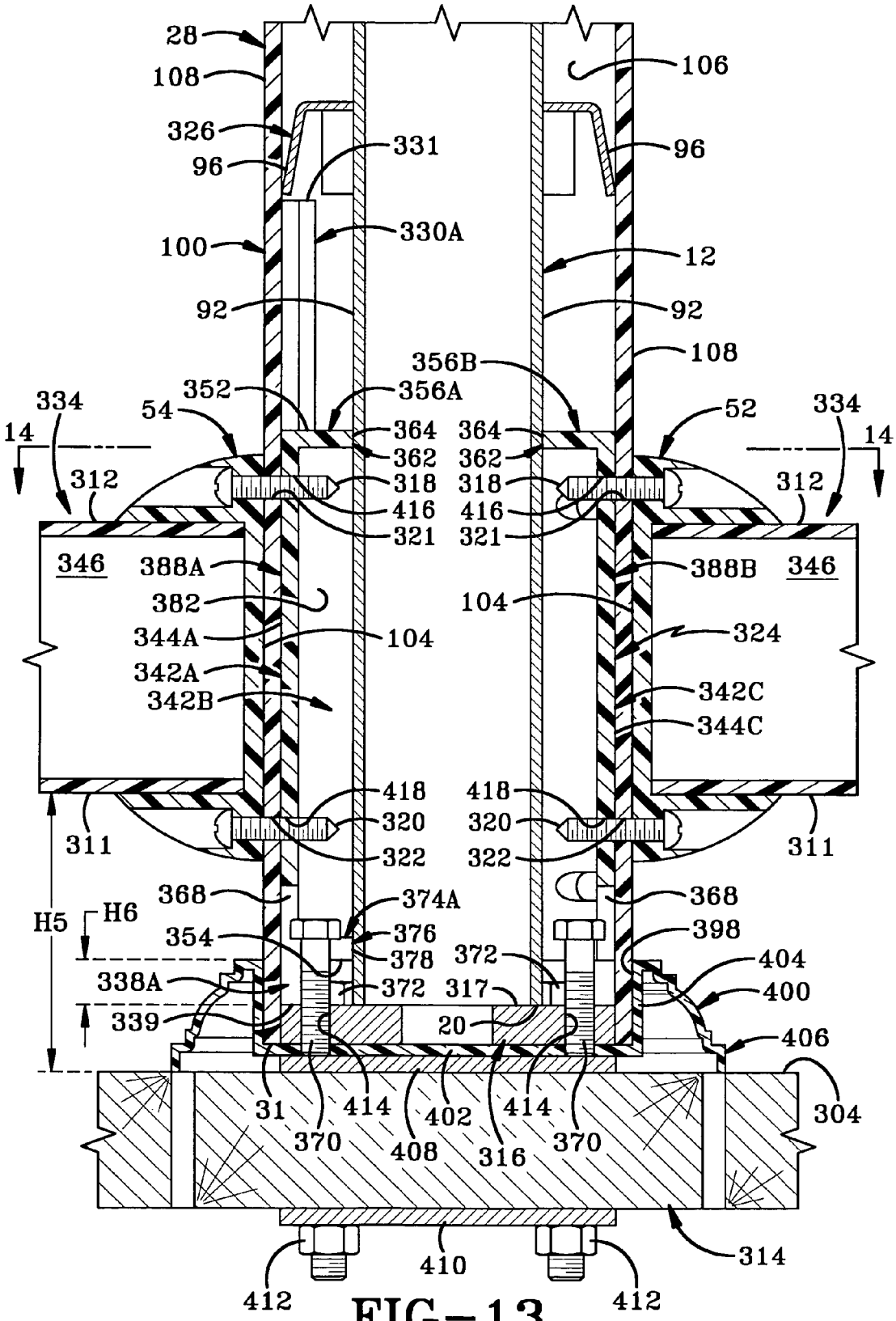
FIG. 13 is a fragmentary sectional view showing the lower portion of the fencing system assembled with the lower rail brackets mounted on the post and the spacer.

In accordance with the invention and with reference to FIGS. 9-12, spacer 324 is described. Spacer 324 includes a body 328, a pair of longer first projections or legs 330A and 330B, and a pair of shorter second projections or legs 338A and 338B (FIG. 13). Longer legs 330 and shorter legs 338 extend from body 328 in substantially opposite directions from one another. Longer legs 330 are longer than shorter legs 338, as indicated in FIG. 10 by length L1 being longer than length L2. Longer legs 330A and B are cantilevered from body 328 and have respective seating surfaces 331 at the free end thereof. Likewise, shorter legs 338A and B are cantilevered from body 328 and have respective seating surfaces 339 at the respective free ends thereof. As shown in FIG. 9, longer legs 330 extend upwardly from body 328 and shorter legs 338 extend downwardly therefrom to support and space body 328 upwardly from an adjustment plate 316 on which post mount 12 at lower end 20 is mounted. However, as will be shown later, spacer 324 may be inverted so that shorter legs 338 extend upwardly and longer leg 330 extend downwardly. Thus, FIG. 9 represents a first mounting position of spacer 324 in which spacer 324 is mounted on post mount 12. In the first mounting position, longer legs 330A are spaced downwardly from but adjacent tab 96 of lower projections 326. Seating surfaces 339 of shorter legs 338 are seated atop an upper surface 317 of adjustment plate 316 in the first position, as best seen in FIG. 13.

Figure 14:
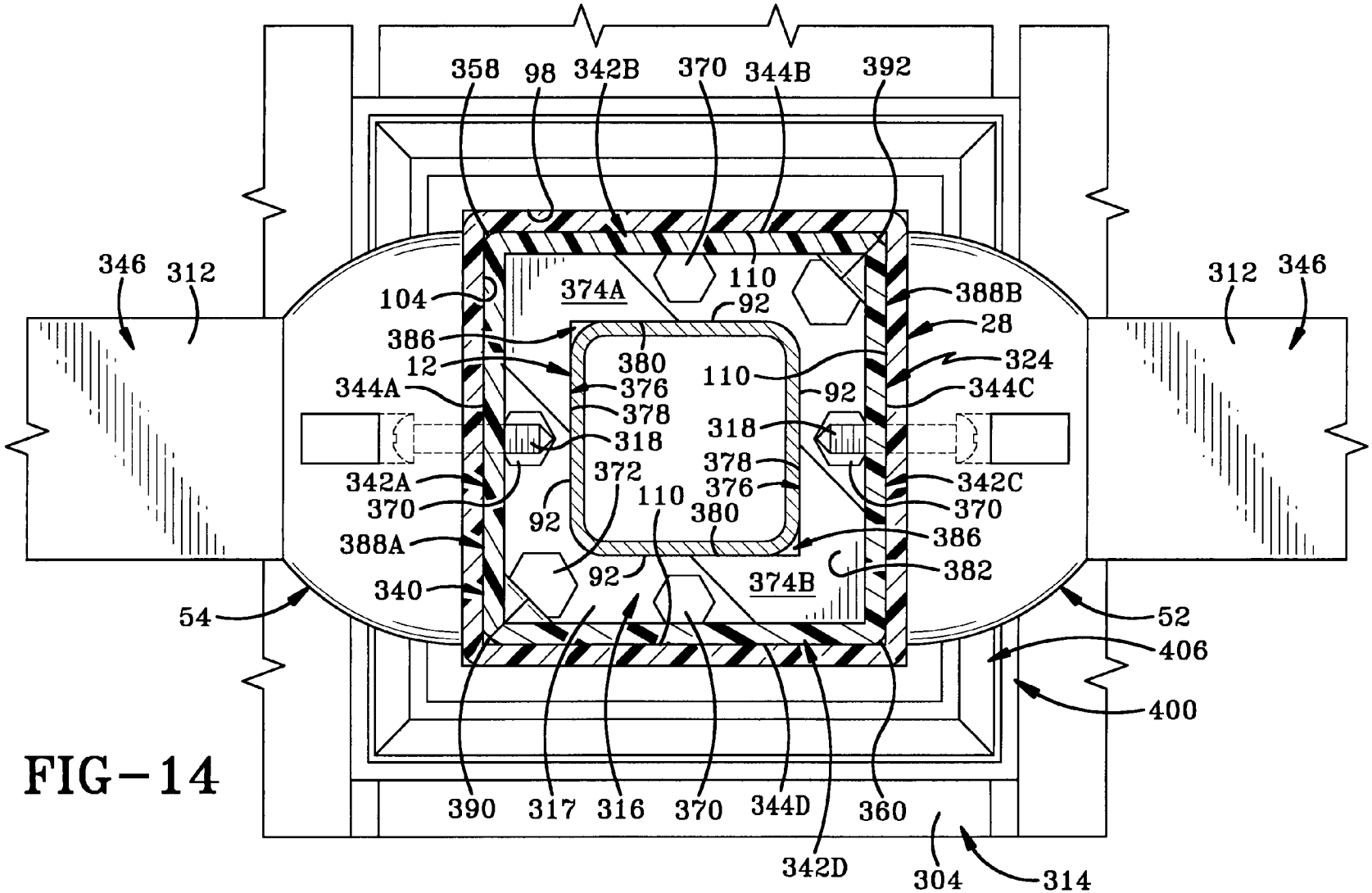
FIG. 14 is a sectional view taken on line 14-14 of FIG. 13.

Body 328 of spacer 324 has a square outer perimeter 340 as viewed from above which is of a mating configuration with inner surface 104 of side wall 100 of post 28, as best seen in FIG. 14. Body 328 includes four substantially flat side walls 342A-D having respective substantially flat outer surfaces 344A-D which define outer perimeter 340. Respective outer surfaces 344 of side walls 342 of spacer 324 are disposed closely adjacent or in abutment with respective interior flat surfaces 110 of post 28. Body 328 has first and second opposed ends 352 and 354 between which side walls 342 and outer surfaces 344 extend in a vertical direction. In the first position of spacer 324, first end 352 serves as a top and second end 354 serves as bottom of body 328 although this will be reversed in the inverted position noted previously. Body 328 further includes a pair of opposed generally L-shaped first engaging flanges 356A and 356B which extend inwardly from respective side walls 342 to engage post mount 12. More particularly, flange 356A extends inwardly from side walls 342A and 342B adjacent an intersection or corner 358 thereof. Similarly, flange 356B extends inwardly from side walls 342C and D adjacent an intersection or corner 360 thereof. Each engaging flange 356 has an L-shaped engaging surface 362 which includes first and second surfaces 364 and 366 which are substantially perpendicular to one another. Engaging surfaces 362 engage outer surface 90 of post mount 12 with each of surfaces 364 and 366 engaging a respective flat portion 92 thereof.

Adjacent second end 354 of body 328, each side wall 342 defines a downwardly opening access opening 368 which extends from a respective outer surface 344 to an inner surface of the respective side wall 342. Each access opening 368 provides access to a respective adjustment screw or bolt 370 each of which is threadably mounted on adjustment plate 316 between a pair of mounting bolts 372 which are disposed adjacent respective corners of adjustment plate 316. Each lower leg 338 extends downwardly from second end 354 adjacent a respective access opening 368 between a respective adjustment screw 370 and mounting bolt 372 so that leg 338 is laterally offset from each of said screw 370 and bolt 372, which allows leg 338 to contact adjustment plate 316 when mounted in the first position. Body 328 further includes adjacent second end 354 a pair of opposed second engaging flanges 374A and 374B which are respectively disposed below first engaging flanges 356A and 356B. Engaging flanges 374 are L-shaped structures which span the distance between adjacent openings 368. Each flange 374 includes an L-shaped engaging surface 376 (FIG. 11) which includes first and second surfaces 378 and 380 which are substantially perpendicular to one another. First and second surfaces 378 and 380 engage respective flat portions 92 of outer surface 90 of post mount 12, as shown in FIG. 14.

Side walls 342 of body 328 define an interior chamber 382 which extends from first end 352 to second end 354. Engaging surfaces 362 define therebetween a post mount receiving opening 384 which communicates with interior chamber 382 adjacent first end 352. Likewise, engaging surfaces 376 define therebetween a post mount receiving opening 386 (FIG. 14) which communicates with interior chamber 382 adjacent second end 354. Post mount 12 extends through each opening 384 and 386 all the way through interior chamber 382 and also extends below second end 354 of body 328 and above first end 352 of body 328.

Conveniently, spacer 324 is formed as a two-piece member which includes first and second spacer members in the form of halves 388A and 388B which are identical to one another. First and second spacer members 388 are removably connected to one another along respective intersections or corners 390 and 392 (FIG. 14) of body 326. More particularly, corner 390 is at the intersection of side wall 342A and side wall 342D and intersection 392 is at the intersection of side wall 342B and 342C. Adjacent respective corners 390 and 392 each spacer member 388 includes a respective projection or peg 394 and a peg receiving hole 396 such that the pegs 394 of half 388A are aligned with the holes 396 of half 388B and vice versa. Pegs 394 preferably fit within holes 396 via a relatively tight frictional engagement which provides structural strength to spacer 324 when halves 388 are joined to one another, but also allows halves 388 to be pulled apart from one another if necessary. Thus, spacer 324 is conveniently mountable on and removable from post mount 12 without the use of tools.

The formation of spacer 324 as two spacer members 388 also allows for the mounting of spacer 324 on post mount 12 at any time during assembly prior to the mounting of post 328 on post mount 12. This is particularly convenient in light of various structures which extend outwardly from outer surface 390 of post mount 12. For example, adjustment plate 316, upper projections 26 and lower projections 326 are each examples of structures having portions or walls which project outwardly from outer surface 90 of post mount 12. Due to the size of post mount receiving openings 384 and 386, neither adjustment plate 316 nor upper and lower projections 26 and 326 could be slid through said openings when spacer members 388 are joined to form spacer 324. Thus, the formation of spacer 324 in two pieces allows spacer 324 to be mounted on post mount 12 in a mounting position between such outwardly extending structures as lower projection 326 and adjustment plate 316 subsequent to their rigid attachment to post mount 12. In addition, the ability to mount spacer 324 on post mount 12 at nearly any time allows post mount 12 and the related structure mounted thereon to be used in the first position of spacer 324 with shorter legs 338 disposed downwardly or in the inverted position with shorter legs 338 extending upwardly.

Referring to FIG. 13, once spacer 324 is mounted on post mount 12, lower end 31 of hollow post 28 slides over post insert 24, upper projections 26, post mount 12, lower projections 326, spacer 324 and plate 316. Lower end 31 of post 28 is disposed in an upwardly opening cavity 398 of a trim member 400. Trim member 400 includes a bottom wall 402 and a side wall 404 which extends upwardly therefrom and defines therewithin cavity 398. Member 400 further includes a decorative wall 406 which extends outwardly and downwardly from an upper end of side wall 404 to surround bottom wall 402 and side wall 404. Lower end 31 of post 28 is seated on bottom wall 402. Adjustment plate 316 is likewise seated on or adjacent bottom wall 402 within interior chamber 106 of post 28. Lower end 20 of post mount 12 is seated on upper surface 317 of plate 316 and rigidly affixed thereto. Bottom wall 402 of trim member 400 is seated on a base plate 408 which is surrounded by decorative wall 406 and is seated on upper surface 304 of floor board 314. A clamping plate 410 is disposed below floor board 314 in abutment therewith with nuts 412 tightened on mounting bolts 372 to clamp floor board 314 between base plate 408 and clamping plate 410 in order to secure post mount 12 to floor board 314 via adjustment plate 316. Adjustment screws 370 threadably engage threaded holes 414 formed in adjustment plate 316 in order to adjust plate 316 with respect to base plate 408 as adjustment screws 370 are threaded in or out as necessary. Once adjusting screws 370 are set to position post mount 12 and post 28 as desired, nuts 412 are tightened to secure post mount 12 in the position as set by screws 370. Access to adjusting screws 370 via a wrench (not shown) or the like is possible via access openings 368.

FIG. 13 shows that mounting screws 318 and 320 extend respectively through holes 321 and 322 of post 28 and respectively through holes 416 and 418 formed in side wall 342A of spacer 324 to secure mounting bracket 54 and an associated lower rail 346 to post 28, spacer 324 and post mount 12 to provide a stable mounting thereof. Rail mounting bracket 52 and an associated lower rail 346 are likewise mounted via side wall 342C of spacer 324. Holes 416 and 418 may be preformed, drilled on site or formed by a self threading screw.

Figure 14A:
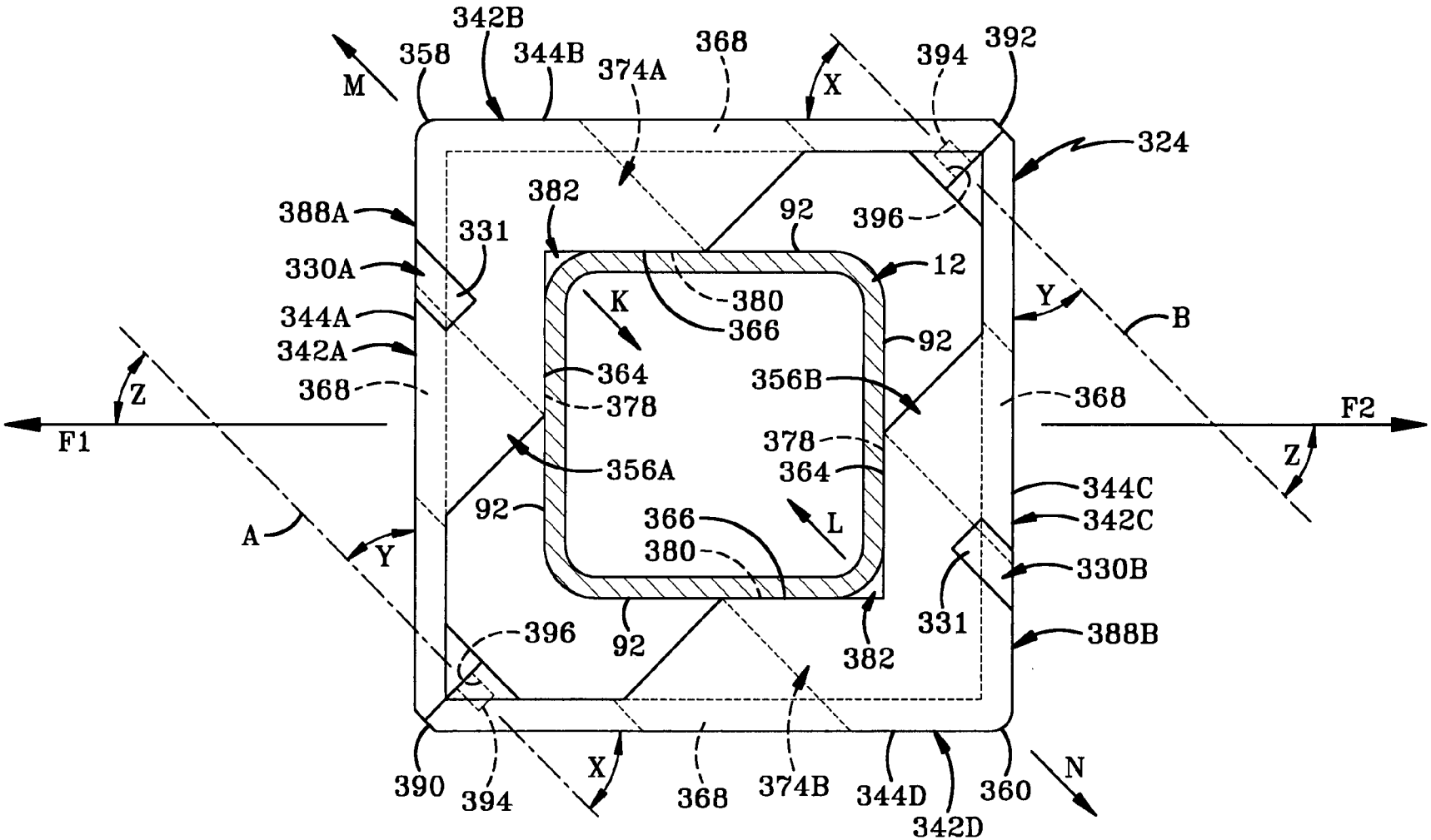
FIG. 14A is a top plan view of the spacer showing the post mount in section.

It is noted that no fasteners such as screws or bolts extend between spacer 324 and post mount 12 in order to join the two together. However, spacer 324 is configured to provide a secure mounting thereof on post mount 12. More particularly, as shown in FIG. 14A, pegs 394 and holes 396 are elongated along respective substantially parallel axes such as shown at axis A and axis B. In accordance with this configuration, force is applied respectively to halves 388A and 388B of spacer 324 in the direction shown at Arrows K and L in order to connect said halves to one another in a press fit manner. Likewise, to separate halves 388A and 388B forces are respectively applied in the linear directions indicated at Arrows M and N, respectively the opposites of Arrows K and L, to overcome a friction fit between pegs 394 and the structure forming holes 396. Thus, the lines of force represented by Arrows K, L, M and N are parallel to axes A and B. However, when spacer 324 is mounted on post mount 12 with post 28 slid over spacer 324, screws 318 and 320 which mount brackets 52 and 54 on spacer 324 create forces respectively represented at F1 and F2 in FIG. 14A which occur in directions which are transverse to the directions represented at Arrows M and N. Thus, even if post 28 were not in position, pegs 394 and the structure defining holes 396 create an interference fit therebetween with respect to the forces applied as at F1 and F2, as opposed to a simple frictional engagement which must be overcome when forces are applied as at Arrows M and N. As a result, force F1 applied to spacer half 388A is translated to spacer half 388B via this interference involving pegs 394. In turn, force F1 is applied to post mount 12 via first surface 364 of first engaging flange 356B and first surface 378 of second engaging flange 374B. Force F1 is thus countered by the engagement between post mount 12 and said surfaces 364 and 378.

Likewise, force F2 applied to spacer half 388B is translated via the interference fit associated with pegs 394 to spacer half 388A and in turn to post mount 12 via surface 364 of first engaging flange 356A and surface 378 of second engaging flange 374A. In addition, spacer 324 is sandwiched between side wall 100 of post 28 and side wall 88 of post mount 12 (FIG. 14) so that side wall 100 also prevents the separation of spacer halves 388A and 388B in response to forces F1 and F2. Spacer 324 thus adds substantial strength and stability for the mounting thereon of lower rail structures 334.

FIG. 14A shows that axes A and B and forces M and N are not perpendicular to any of flat outer surfaces 344A-D of body 326 of spacer 324, as indicated by angles X and Y. One benefit of this configuration is that screws 318 and 320 for mounting brackets 52 and 54 may be screwed into side walls 342B and D instead of 342A and C whereby the corresponding forces applied by screws 318 and 320 would be perpendicular to the forces shown at F1 and F2 while also being transverse to axes A and B and forces M and N. Thus, if mounting brackets 52 and 54 were mounted on side walls 342B and 344D, the same concept would apply with regard to the interference created between pegs 94 and the structure defining holes 396. Further, mounting brackets such as 52 and 54 may be mounted on two or more of sides 342A-D with the benefits just previously mentioned, such as when post 28 is a corner post with rails extending perpendicularly therefrom. Preferably, angles X and Y are each approximately 45°. The fact that forces F1 and F2 have a direction which is transverse to axes A and B and forces M and N is represented at angles Z, which are also preferably 45°.

Figure 15:
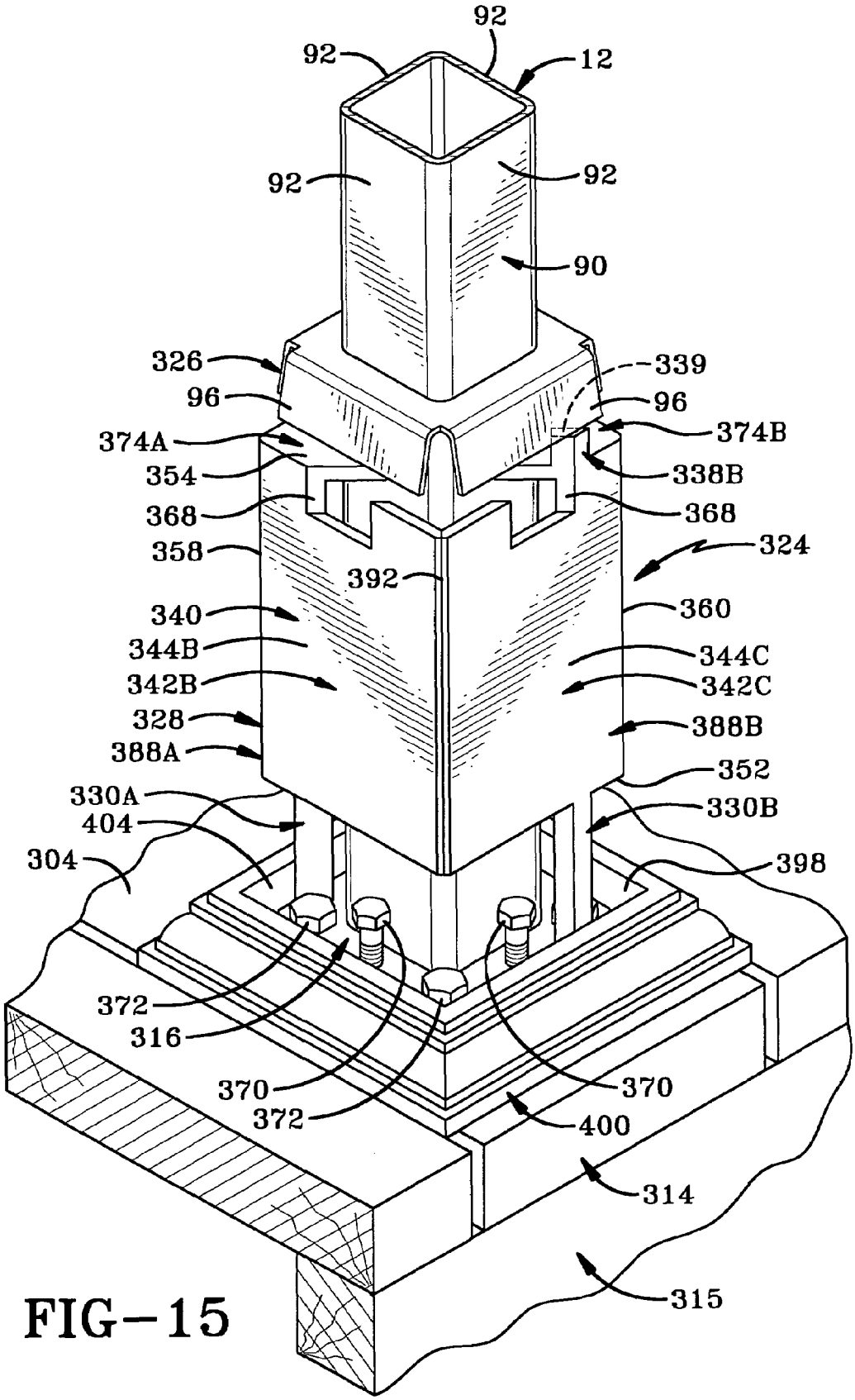
FIG. 15 is similar to FIG. 9 and shows the spacer in an inverted position.
Figure 16:
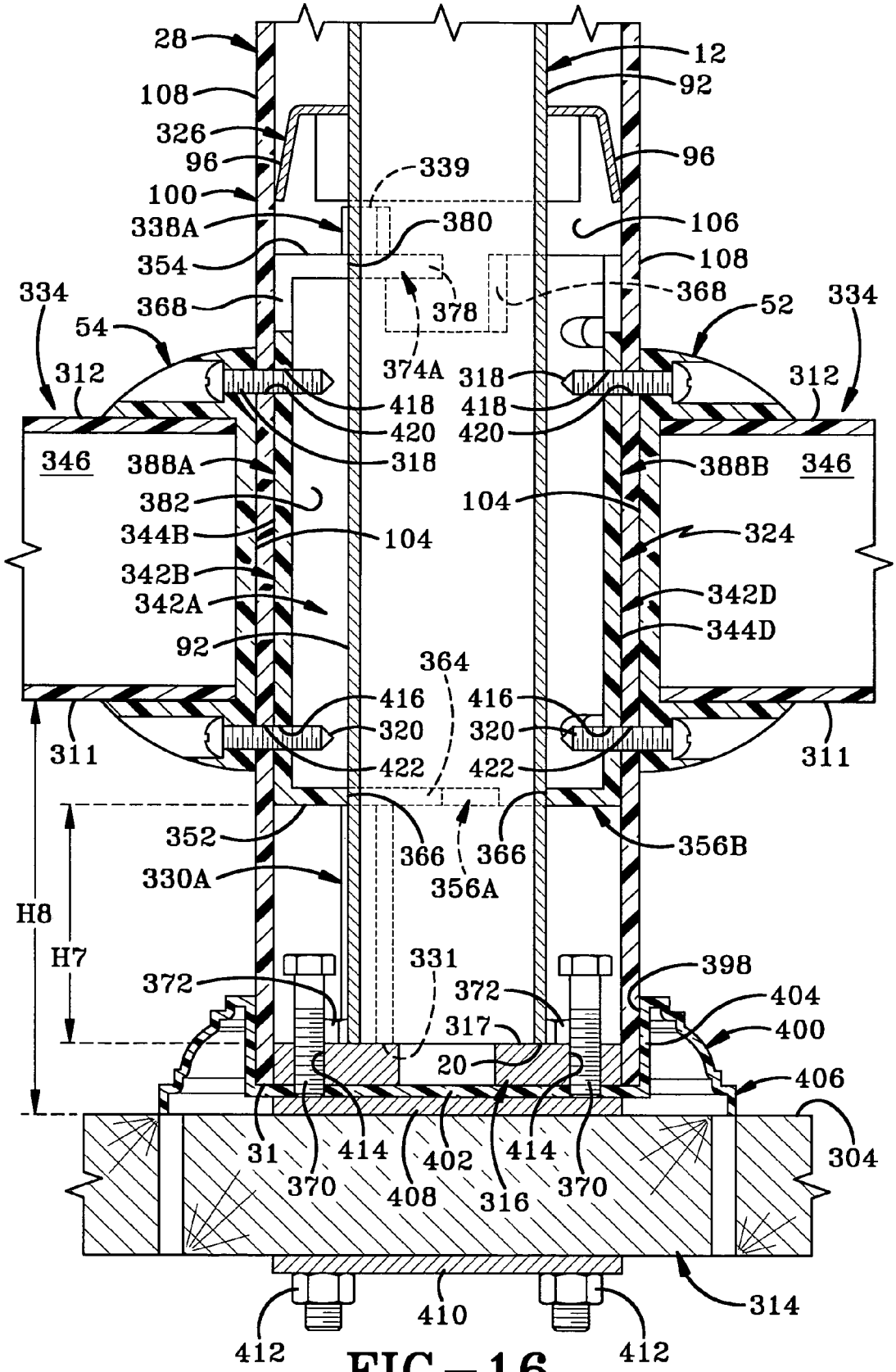
FIG. 16 is similar to FIG. 13 and shows the spacer in the inverted position.

FIGS. 15 and 16 show spacer 324 in the inverted position with shorter legs 338 extending upwardly from body 328 and longer legs 330 extending downwardly from body 328 with respective seating surfaces 331 of leg 330 seated on upper surface 317 of adjustment plate 316. Each longer leg 330 is laterally offset from and disposed between a respective mounting bolt 372 and adjustment screw 370. Each lower leg 330 is also in abutment with side wall 404 of trim member 400. In the inverted position, first end 352 of body 328 becomes the lower end thereof and second end 354 becomes the upper end thereof. Thus, in the inverted position, longer legs 330 position body 328 of spacer 324 at a height which greater than that set by shorter legs 338 in the first position shown in FIG. 13. More particularly, longer legs 330 space first end 352 of body 328 from upper surface 317 of plate 316 at a distance or height H7 whereby respective mounting screws 318 and 320 are disposed at heights which are respectively higher than the heights thereof in the first position of FIG. 13. Likewise, mounting brackets 52 and 54 are disposed higher than in the inverted position as are lower rails 346. More particularly, lower surface 311 of lower rail 334 is spaced upwardly from upper surface 304 of floor board 314 at a distance or height H8.

Thus, height H7 of the inverted position is greater than height H6 of the first position (FIG. 13) and height H8 of the inverted position is greater than height H5 of the first position. The heights of rails 346, brackets 52 and 54, screws 318 and 320 and body 328 of spacer 324 may all be stated with reference to other structures such as base plate 408 and bottom wall 402 of trim member 400. Likewise, rail 334, brackets 52 and 54 and the corresponding screws 318 and 320 as well as body 328 of spacer 324 in the inverted position are all closer to the various structures thereabove, such as lower projections 326, upper projections 26, post insert 24 and upper rail structures 332. Accordingly, for an upper rail structure 332 having a given height, the balusters 302 associated with the raised position of lower rail structure 346 when spacer 324 is in the inverted position have a shorter length D1 than do balusters 302 which are used when lower rail structure 334 is in the lower position when spacer 324 is in the first position shown in FIGS. 6 and 13. Likewise, distance D2 (FIG. 6) between upper and lower rails 336 and 346 when spacer 324 is in the inverted position is less than when spacer 324 is in the first position.

In the inverted position of spacer 324, holes 420 and 422 are formed in respective side walls of post 28 which are respectively higher than holes 321 and 322 formed in post 28 when spacer 324 is in the first position (FIG. 13). Depending on the difference in height of mounting brackets 52 and 54 when respectively in the first position and inverted position of spacer 324, if holes 321, 322, 420 and 422 are all preformed, a respective pair of these holes associated respectively with the first position and the inverted position of spacer 324 may or may not be covered by mounting brackets 52 and 54 in the other of the first and inverted positions. If the holes will not be covered by mounting bracket 52 and 54, it may be desirable to form only one of the pairs of holes as shown in FIGS. 13 and 16 respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A fencing system comprising:

a post mount having upper and lower ends;

a post insert comprising a sidewall spaced outwardly from the post mount;

the post insert mountable on the post mount so that the post mount extends through the post insert with the upper end of the post mount disposed above the sidewall and the lower end of the post mount disposed below the sidewall;

a first flange which is connected to and extends inwardly from the sidewall and abuts the post mount;

a second flange which is spaced vertically from the first flange, is connected to and extends inwardly from the sidewall and abuts the post mount;

a first surface on the first flange;

a second surface on the second flange which faces the first surface so that the first and second surfaces define therebetween an interior chamber;

at least one first spacing projection connected to and extending outwardly from the first flange away from the interior chamber and outwardly beyond the sidewall in a first direction;

a first seating surface on the at least one first spacing projection on which the post insert is seatable on an upwardly facing surface to set a first height of the sidewall;

at least one second spacing projection connected to and extending outwardly from the second flange away from the interior chamber and outwardly beyond the sidewall in a second direction generally opposite to that of the first direction;

a second seating surface on the at least one second spacing projection on which the post insert is alternately seatable on the upwardly facing surface to set a second height of the sidewall different from the first height;

a structural member having an inner surface defining a cavity in an end thereof; the post mount and post insert being slidably received in the cavity of the structural member with the inner surface thereof abutting the sidewall of the post insert;

a rail structure extending outwardly from the structural member; and at least one fastener extending from the rail structure through the structural member to the sidewall to secure the rail structure and the structural member to the sidewall.

2. The system of claim 1 wherein the post insert includes first and second members; and further comprising a press fit connection between the first and second members by which they are removably connected to one another.

3. The system of claim 2 wherein the first and second members are removable from one another by linear movement of the first and second members away from one another in a third direction; wherein the at least one fastener applies an outwardly directed force on the first member in a fourth direction transverse to the third direction; and wherein when the force is applied an interference caused by the press fit connection exists between the first and second members which inhibits removal of the first and second members from one another and which does not exist when the first and second members are moved in the third direction.

4. The system of claim 3 wherein the second member has an inwardly facing engaging surface disposed adjacent the post mount on an opposite side thereof from the at least one fastener; wherein the force is translated from the first member to the second member via the interference therebetween so that the engaging surface applies force to the post mount.

5. The system of claim 3 wherein the third and fourth directions are at an acute angle relative to one another.

6. The system of claim 5 wherein the third and fourth directions are at an angle of about 45 degrees relative to one another.

7. The system of claim 1 wherein the rail structure includes a rail mounting bracket defining a hole through which the at least one fastener extends to secure the rail mounting bracket to the post mount.

8. The system of claim 1 wherein the first flange comprises a first horizontal wall which is connected to and extends inwardly from the sidewall, abuts the post mount and comprises the first surface; the at least one first spacing projection is connected to and extends outwardly from the first horizontal wall; the second flange comprises a second horizontal wall which is vertically spaced from the first horizontal wall, is connected to and extends inwardly from the sidewall, abuts the post mount and comprises the second surface; and the at least one second spacing projection is connected to and extends outwardly from the second horizontal wall.

9. The system of claim 1 further comprising a seating wall fixedly connected to and extending outwardly from the post mount; and wherein the upwardly facing surface is on the seating wall; and the first and second seating surfaces are alternately seatable on the upwardly facing surface of the seating wall.

10. The system of claim 9 wherein the sidewall of the post insert has first and second opposed ends; the first and second flanges extend inwardly respectively from adjacent the first and second opposed ends; the at least one first spacing projection extends downwardly from the first flange when the first seating surface is seated on the upwardly facing surface of the seating wall; and further comprising a hole formed in the seating wall; an externally threaded member extending downwardly through the hole; and an access opening formed in the sidewall extending from its first end toward its second end and upwardly of the first flange and at least one first spacing projection above the externally threaded member to provide access to the threaded member when the first seating surface is seated on the upwardly facing surface of the seating wall.

11. The system of claim 1 wherein the first flange is disposed entirely above the at least one fastener and the second flange is disposed entirely below the at least one fastener.

12. The system of claim 1 wherein the post insert comprises first and second members; and further comprising a press fit connection which joins the first and second members to one another and is formed by movement of the first member toward the second member in a linear third direction; and wherein the at least one fastener extends in a fourth direction transverse to the third direction from the rail structure through the structural member to the sidewall of the post insert.

13. The system of claim 12 wherein the third and fourth directions are at an acute angle relative to one another.

14. The system of claim 13 wherein the third and fourth directions are at an angle of about 45 degrees relative to one another.

15. The system of claim 13 further comprising at least one hole formed in the first member; and at least one peg on the second member extending in the third direction and removably insertable into the hole to form the press fit connection.

16. The system of claim 15 wherein the at least one fastener comprises an externally threaded shaft which is elongated in the fourth direction.

17. The system of claim 13 wherein the at least one fastener comprises an externally threaded shaft which is elongated in the fourth direction.

18. A fencing system comprising:

a post mount having upper and lower ends;

a seating wall fixedly connected to the post mount adjacent its lower end and extending outwardly therefrom;

a post insert mountable on the post mount and comprising a body extending outwardly from the post mount; the post mount extending through the post insert with the upper end disposed above the body and the lower end disposed below the body;

at least one shorter spacing projection connected to and extending outwardly from the body and seatable on the seating wall to set the body at a first height above the seating wall;

at least one longer spacing projection connected to and extending outwardly from the body a further distance from the body than does the shorter projection in a direction generally opposite to that of the shorter projection and alternately seatable on the seating wall to set the body at a second height above the seating wall which is higher than the first height;

a structural member having an inner surface defining a cavity in an end thereof; the post mount and post insert being slidably received in the cavity of the structural member;

a rail structure extending outwardly from the structural member;

at least one fastener extending from the rail structure through the structural member to the body of the post insert to secure the rail structure and the structural member to the body;

a plurality of externally threaded members on and extending downwardly from the seating wall; and wherein the plurality of externally threaded members comprises four externally threaded members; the body of the post insert has first and second opposed ends from which the shorter and longer spacing projections respectively extend outwardly; the body comprises four sidewalls each having a substantially flat outer surface disposed closely adjacent or abutting the inner surface of the structural member when received therein; and further comprising four access openings formed respectively in the four sidewalls each extending from the first end of the body toward the second end of the body respectively above the four externally threaded members to provide access to the four threaded members when the at least one shorter spacing projection is seated on the seating wall.

19. The system of claim 18 wherein the threaded members comprise a plurality of mounting bolts adapted for mounting the post mount on a foundation.

20. The system of claim 18 wherein the threaded members comprise a plurality of adjustment screws for adjusting the inclination of the post mount.

21. The system of claim 18 further comprising a plurality of internally threaded holes formed in the seating wall and threadably engaging the respective externally threaded members.

22. The system of claim 18 further comprising a plurality of holes formed in the seating wall through which the externally threaded members respectively extend downwardly.

* * * * *